US011529646B2

(12) United States Patent
Childers

(10) Patent No.: US 11,529,646 B2
(45) Date of Patent: Dec. 20, 2022

(54) COMPOUND ELLIPTICAL REFLECTOR FOR CURING OPTICAL FIBERS

(71) Applicant: Phoseon Technology, Inc., Hillsboro, OR (US)

(72) Inventor: Doug Childers, Portland, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 732 days.

(21) Appl. No.: 16/404,574

(22) Filed: May 6, 2019

(65) Prior Publication Data

US 2019/0262860 A1 Aug. 29, 2019

Related U.S. Application Data

(63) Continuation of application No. 15/168,540, filed on May 31, 2016, now Pat. No. 10,328,457, which is a (Continued)

(51) Int. Cl.
*B05D 3/06* (2006.01)
*H05B 3/00* (2006.01)
(Continued)

(52) U.S. Cl.
CPC ..... *B05D 3/067* (2013.01); *F26B 3/28* (2013.01); *H05B 3/0038* (2013.01); *B05D 7/546* (2013.01)

(58) Field of Classification Search
CPC ..... B05D 3/067; B05D 3/0263; B05D 7/546; B05D 2202/45; B05D 2256/00; H05B 3/0038; H05B 3/0047; H05B 2203/032; F26B 3/28; F26B 13/00; C03C 25/12; G21K 1/067; G21K 5/00; G21K 2201/064; G21K 2201/065; G26B 13/02;
(Continued)

(56) References Cited

U.S. PATENT DOCUMENTS 4,591,724 A * 5/1986 Fuse ..... B29C 35/10 976/DIG. 440
5,418,369 A 5/1995 Moore et al.
(Continued)

FOREIGN PATENT DOCUMENTS

CN 201741507 U 2/2011
CN 102171526 A 8/2011
(Continued)

OTHER PUBLICATIONS

ISA Korean Intellectual Property Office, International Search Report and Written Opinion Issued in Application No. PCT/US2014/047666, dated Nov. 25, 2014, WIPO, 12 pages.
(Continued)

*Primary Examiner* — Shawntina T Fuqua
(74) *Attorney, Agent, or Firm* — McCoy Russell LLP

(57) ABSTRACT

A curing device comprises a first elliptic cylindrical reflector and a second elliptic cylindrical reflector, the first elliptic cylindrical reflector and the second elliptic cylindrical reflector arranged to have a co-located focus, and a light source located at a second focus of the first elliptic cylindrical reflector, wherein light emitted from the light source is reflected to the co-located focus from the first elliptic cylindrical reflector and retro-reflected to the co-located focus from the second elliptic cylindrical reflector.

20 Claims, 10 Drawing Sheets

Related U.S. Application Data continuation of application No. 13/948,868, filed on Jul. 23, 2013, now Pat. No. 9,370,046.

(51) Int. Cl.
*F26B 3/28* (2006.01)
*B05D 7/00* (2006.01)

(58) Field of Classification Search
CPC ..... B01J 19/123; B01J 19/127; B01J 19/128; B01J 2219/0879
See application file for complete search history.

(56) References Cited

U.S. PATENT DOCUMENTS

| | | | | |
|---|---|---|---|---|
| 6,626,561 | B2 * | 9/2003 | Carter | F26B 13/002 362/346 |
| 7,265,365 | B2 | 9/2007 | Arvin et al. | |
| 7,291,846 | B2 | 11/2007 | Cekic et al. | |
| 7,923,706 | B2 | 4/2011 | Brassell et al. | |
| 2011/0002058 | A1 * | 1/2011 | Leonhardt | F26B 3/28 359/869 |
| 2013/0068969 | A1 * | 3/2013 | Childers | G21K 1/067 250/492.1 |

FOREIGN PATENT DOCUMENTS

| | | | |
|---|---|---|---|
| EP | 0660148 | A1 | 6/1995 |
| JP | H05229855 | A | 9/1993 |
| JP | H06104217 | B2 | 12/1994 |
| JP | 2012504853 | A | 2/2012 |

OTHER PUBLICATIONS

State Intellectual Property Office of the People's Republic of China, Office Action and Search Report Issued in Application No. 201480040096.2, dated Jan. 9, 2018, 21 pages. (Submitted with Partial Translation).
Taiwan Intellectual Property Office, Office Action and Search Report Issued in Application No. 103120807, dated Jun. 26, 2018, 18 pages. (Submitted with Translation of Search Report).
Japanese Patent Office, Office Action Issued in Application No. 2016529833, dated Jul. 24, 2018, 7 pages.

* cited by examiner

COMPOUND ELLIPTICAL REFLECTOR FOR CURING OPTICAL FIBERS

CROSS REFERENCE TO RELATED APPLICATIONS

The present application is a continuation of U.S. Non-Provisional application Ser. No. 15/168,540 entitled "COMPOUND ELLIPTICAL REFLECTOR FOR CURING OPTICAL FIBERS," and filed on May 31, 2016. U.S. Non-Provisional application Ser. No. 15/168,540 is a continuation of U.S. Non-Provisional application Ser. No. 13/948,868, entitled "COMPOUND ELLIPTICAL REFLECTOR FOR CURING OPTICAL FIBERS," and filed on Jul. 23, 2013, now U.S. Pat. No. 9,370,046. The entire contents of each of the above-listed applications are hereby incorporated by reference for all purposes.

BACKGROUND AND SUMMARY

Optical fibers are used ubiquitously in lighting and imaging applications, as well as in the telecommunication industry, where they provide higher data transmission rates over longer distances as compared to electric wiring. In addition, optical fibers are more flexible, lighter, and can be drawn into thinner diameters than metal wiring, allowing for higher-capacity bundling of fibers into cables. Surface coatings, applied via an ultra-violet (UV) curing process, are employed to protect optical fibers from physical damage and moisture intrusion, and to maintain their long-term durability in performance.

Carter et al. (U.S. Pat. No. 6,626,561) addresses UV curing uniformity issues for optical fibers having surfaces that are located outside a focal point of a UV curing device employing an elliptical reflector to direct UV light from a single UV light source positioned at a second focal point of the elliptical reflector, to the surface of the optical fiber. Curing uniformity issues can arise due to imprecise alignment of the optical fiber relative to the light source, or an irregular-shaped optical fiber. To address these issues, Carter uses a UV lamp structure employing an elliptical reflector to irradiate optical fiber surfaces positioned in the vicinity of a second elliptical reflector focal point with UV light from a single light source positioned in the vicinity of a first elliptical reflector focal point, wherein both the optical fiber and bulb are displaced slightly from the focal points. In this manner, the UV light rays reaching the surface of the optical fiber are dispersed, and the irradiation and curing of the optical coating can potentially be more uniform.

The inventor herein has recognized a potential issue with the above approach. Namely, by displacing the UV light source and the optical fiber away from the focal points of the elliptical reflector, the intensity of UV light irradiating the optical fiber surfaces is dispersed and reduced, thereby lowering the curing and production rates, and imparting higher manufacturing costs.

One approach that addresses the aforementioned issues includes a curing device, comprising a first elliptic cylindrical reflector and a second elliptic cylindrical reflector, the first elliptic cylindrical reflector and the second elliptic cylindrical reflector arranged to have a co-located focus, and a light source located at a second focus of the first elliptic cylindrical reflector, wherein light emitted from the light source is reflected to the co-located focus from the first elliptic cylindrical reflector and retro-reflected to the co-located focus from the second elliptic cylindrical reflector. In another embodiment, a method of curing a workpiece comprises drawing the workpiece along a co-located focus of a first elliptic cylindrical reflector and a second elliptic cylindrical reflector, irradiating UV light from a light source positioned at a second focus of the first elliptic cylindrical reflector, reflecting the irradiated UV light from the first elliptic cylindrical reflector on to a surface of the workpiece, and retro-reflecting the irradiated UV light from the second elliptic cylindrical reflector on to the surface of the workpiece. In a further embodiment, a method comprises positioning a workpiece along a first interior axis of a reflector, wherein the reflector comprises first curved surfaces having a first curvature and second curved surfaces having a second curvature, positioning a light source along a second interior axis of the reflector, and emitting light from the light source, wherein the emitted light is reflected from the first curved surfaces and from the second curved surfaces onto the workpiece.

It will be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
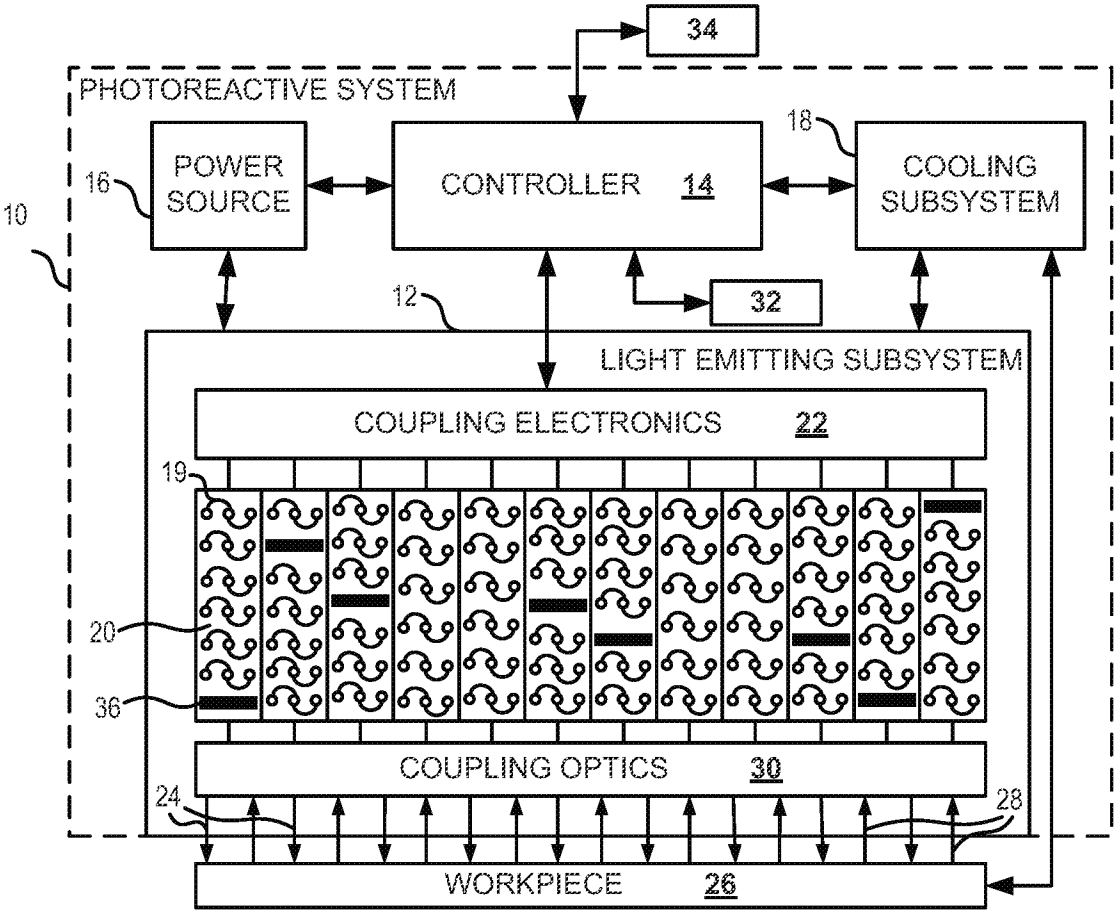
FIG. 1 illustrates an example of a photoreactive system, comprising a power source, a controller, and a light-emitting subsystem.
Figure 2:
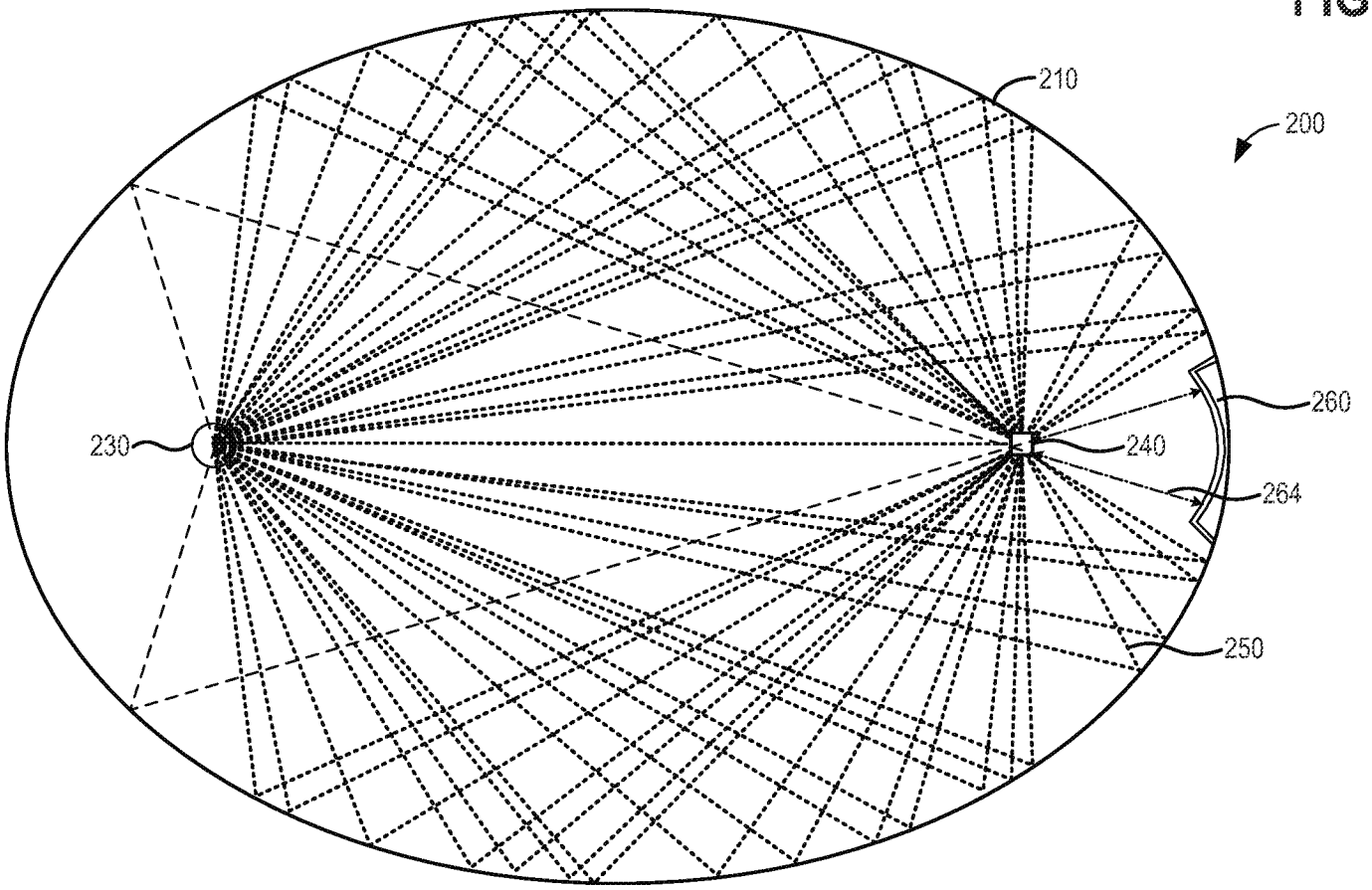
FIG. 2 illustrates a cross-section of an elliptic cylindrical reflector for a UV curing device with a single light source.
Figure 3:
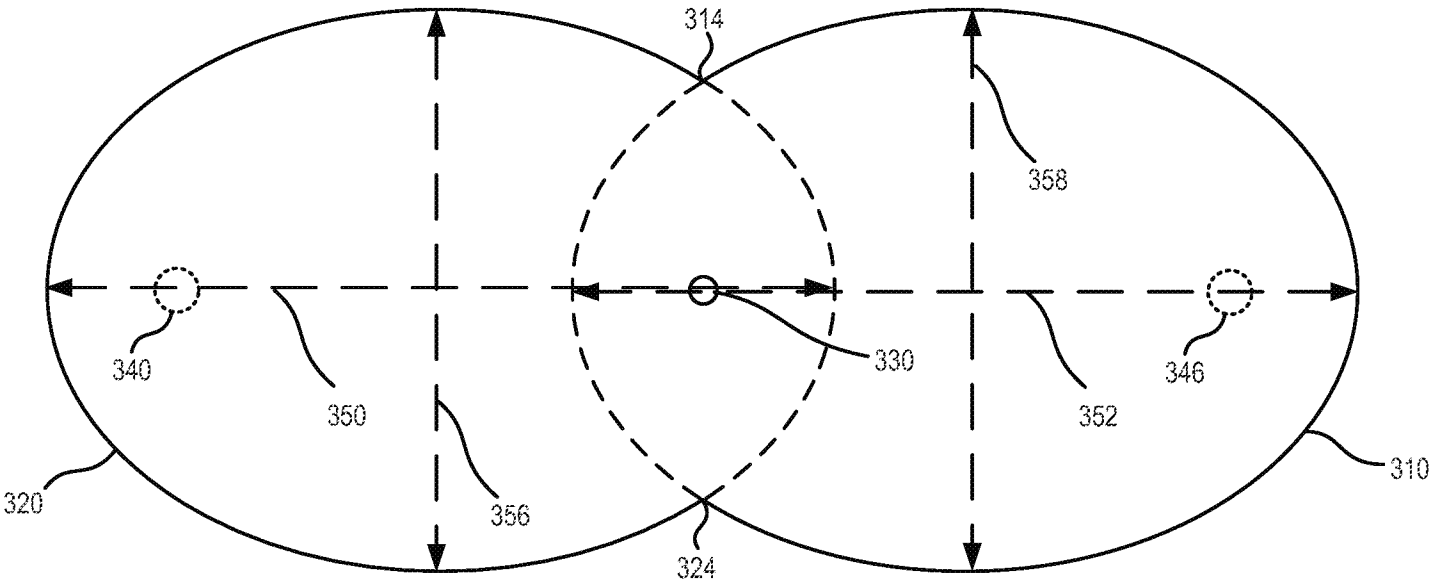
FIG. 3 illustrates a cross-section of an example of two elliptical surfaces arranged with a co-located focus.
Figure 4:
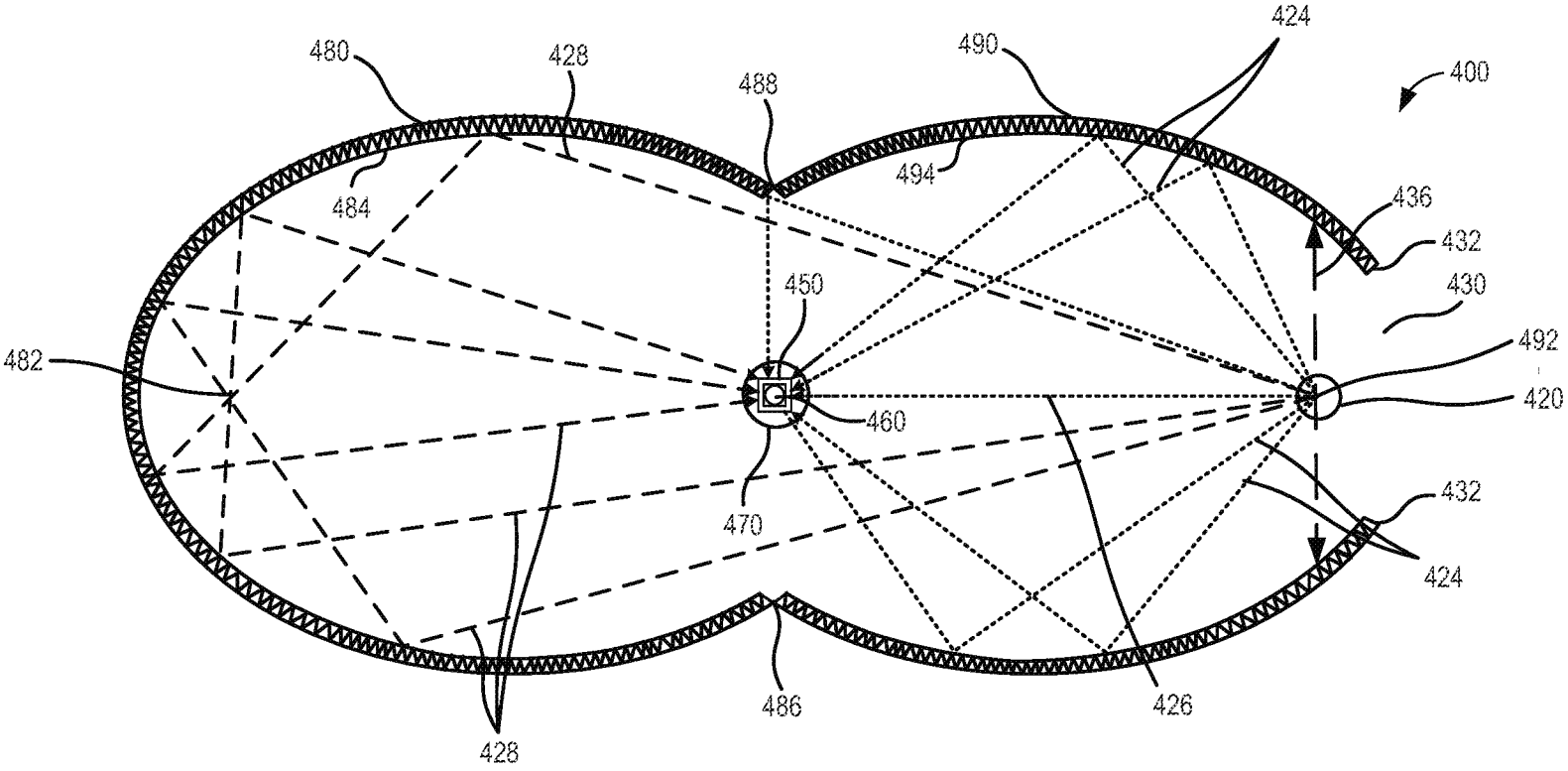
FIG. 4 illustrates a cross-section of an example configuration of dual elliptical reflectors arranged to have a co-located focus.
Figure 5:
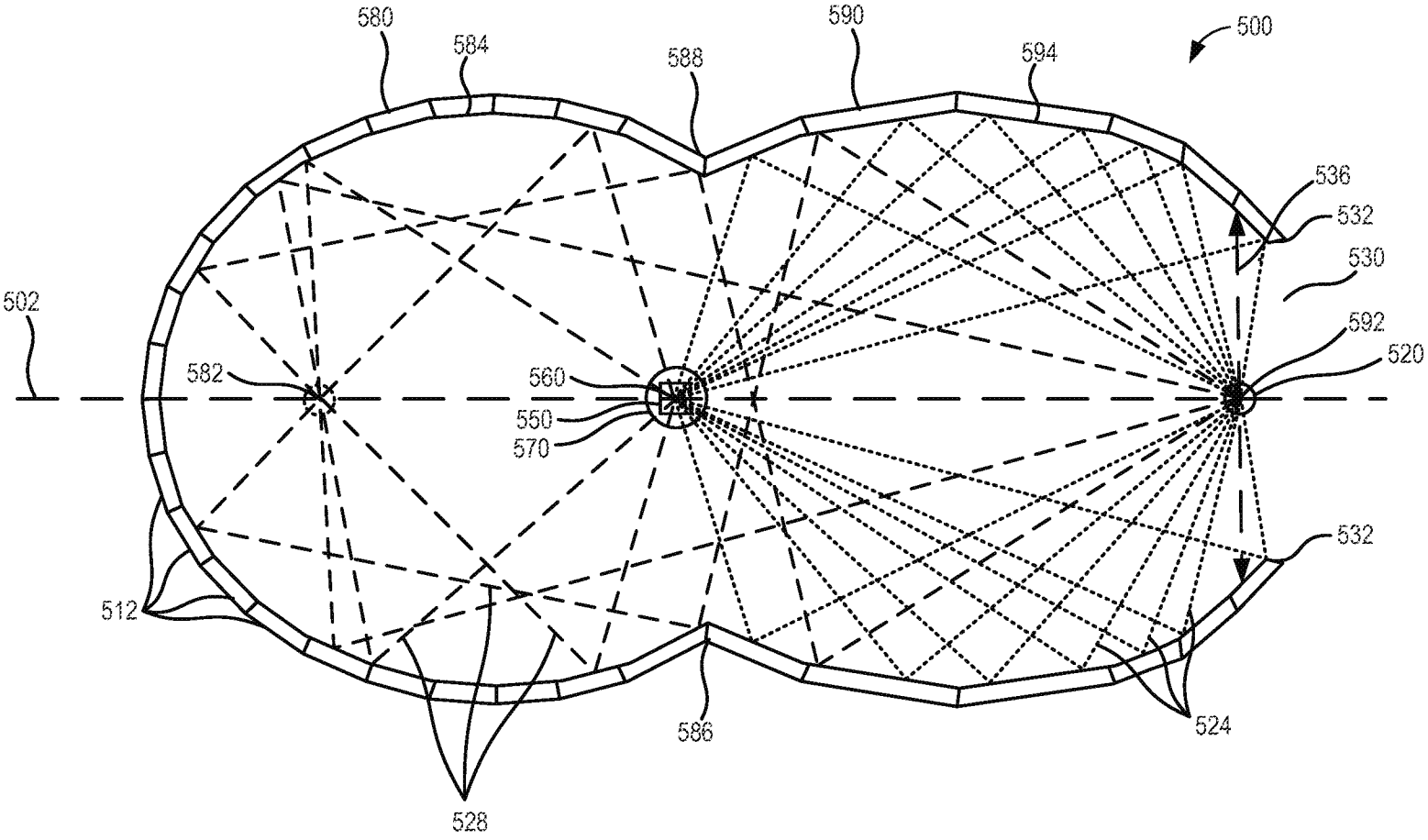
FIG. 5 illustrates a cross-section of an example curing device including dual elliptical reflectors, and a light source located at a second focus of one of the elliptical reflectors.
Figure 6:
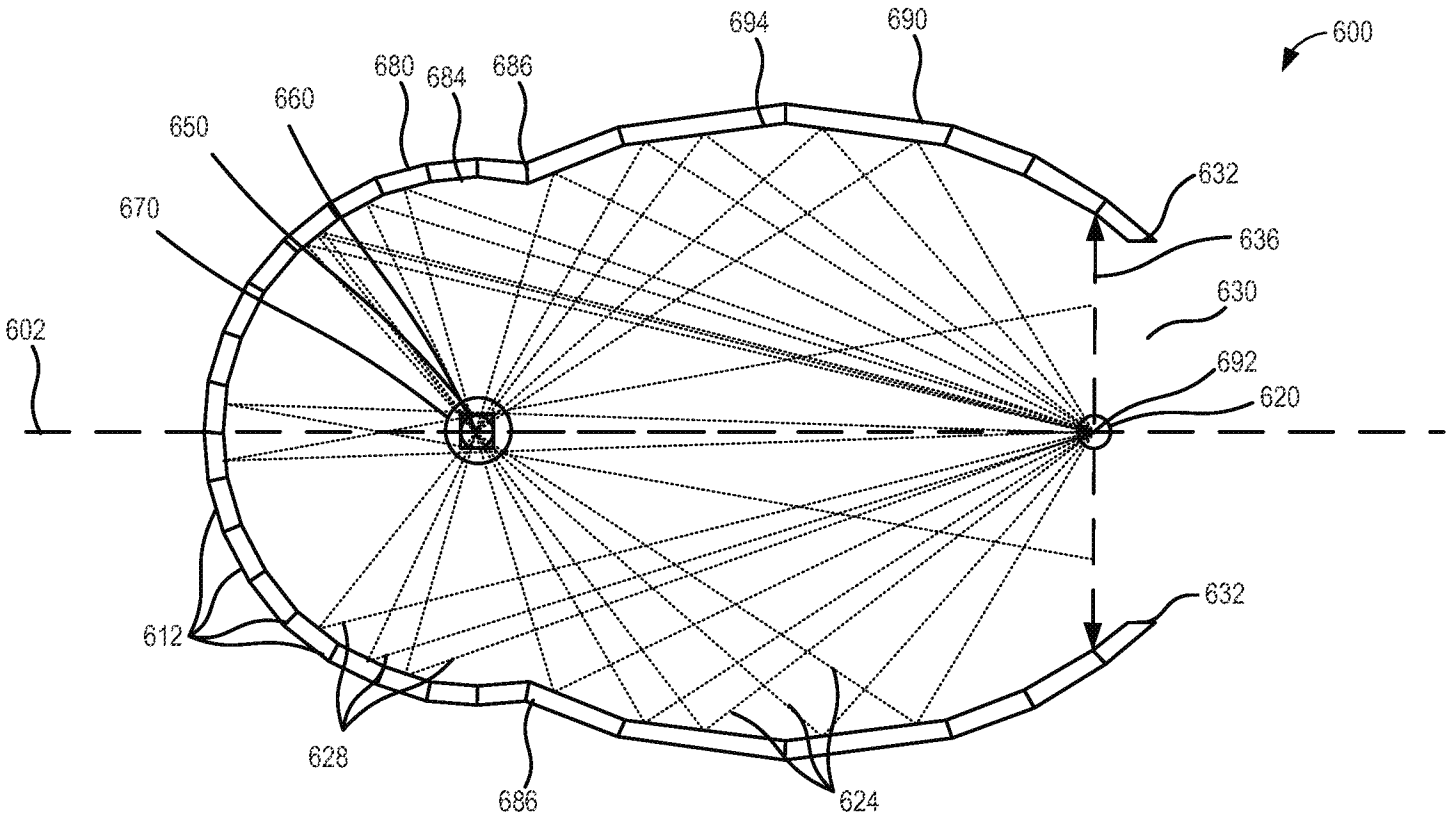
FIG. 6 illustrates a cross-section of an example curing device including dual elliptical reflectors, and a light source located at a second focus of one of the elliptical reflectors.
Figure 7:
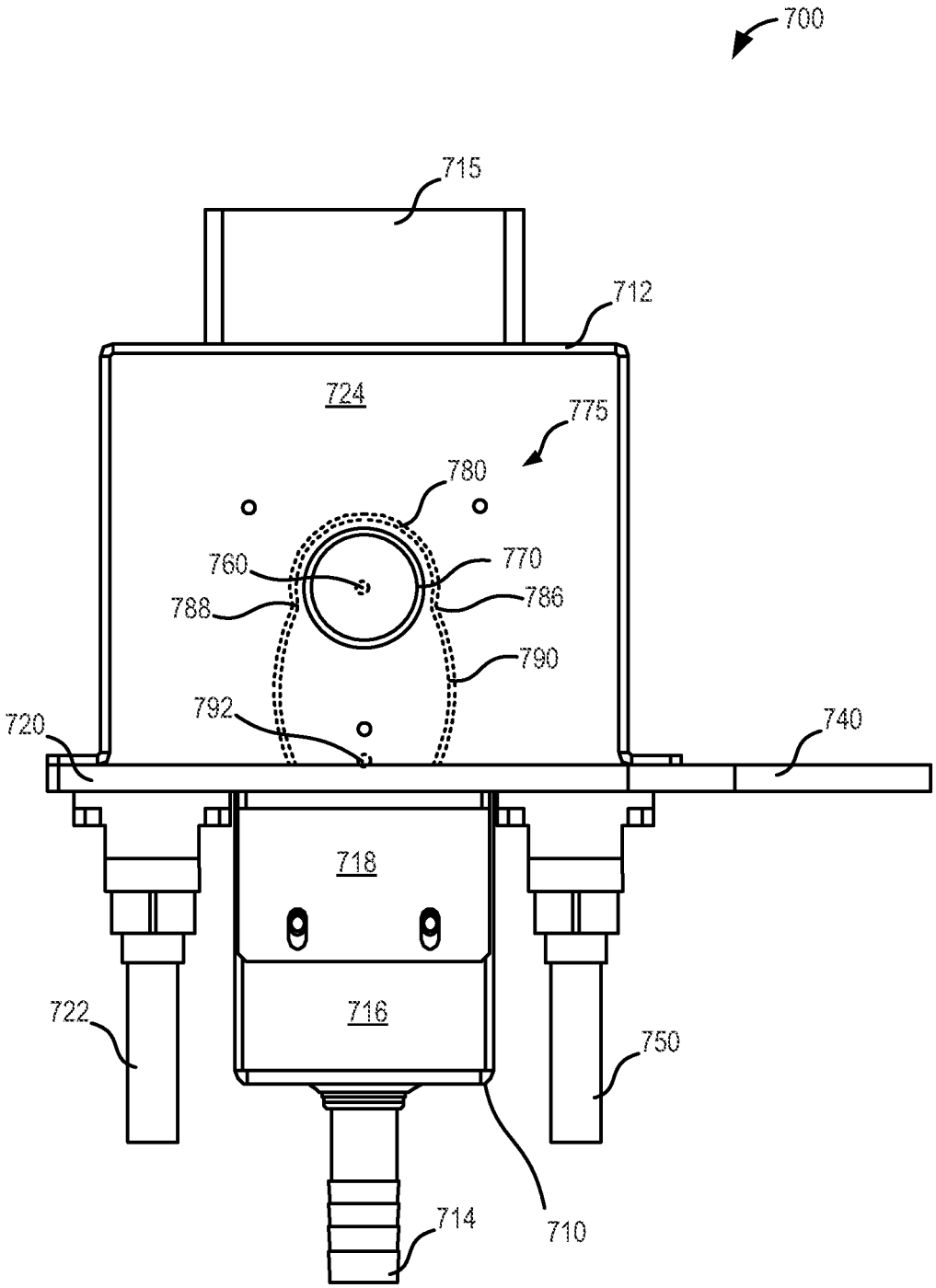
FIG. 7 illustrates a cross-section of an example photoreactive system.
Figure 8:
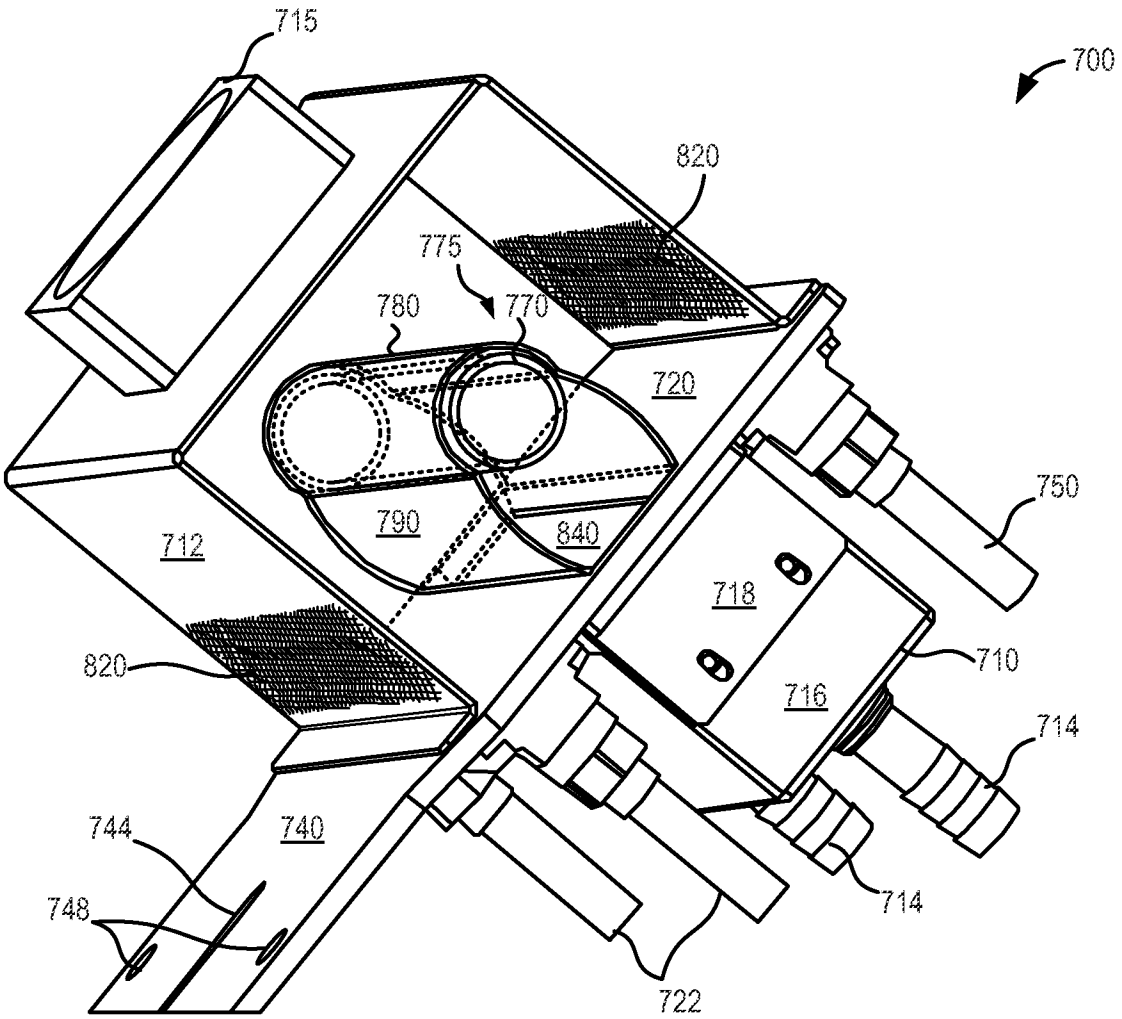
FIG. 8 illustrates a perspective cross-section of an example photoreactive system.
Figure 10:
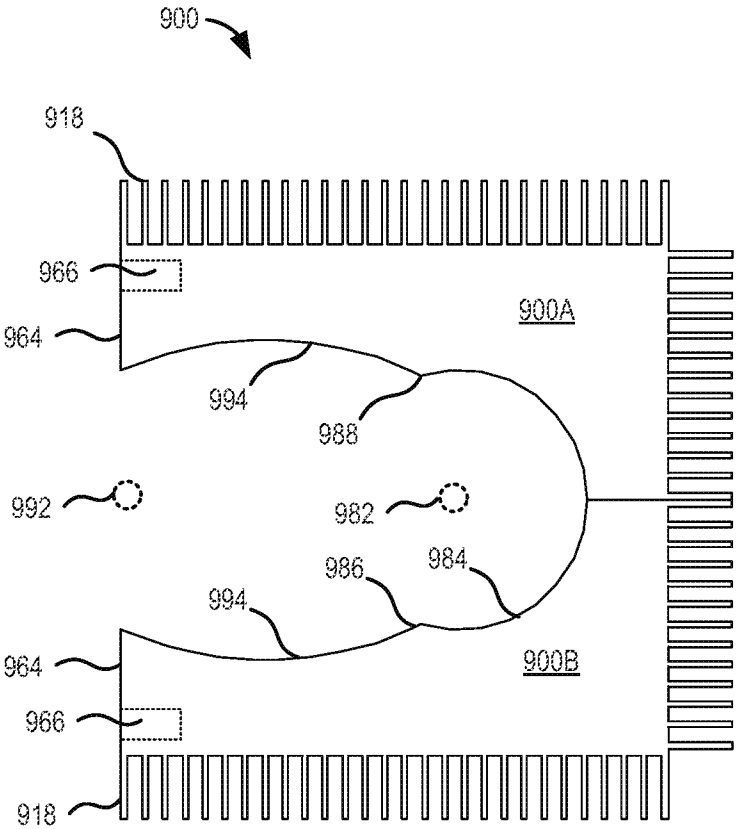
FIG. 10 illustrates an end cross-section of the dual elliptical reflector of FIG. 9.
Figure 9:
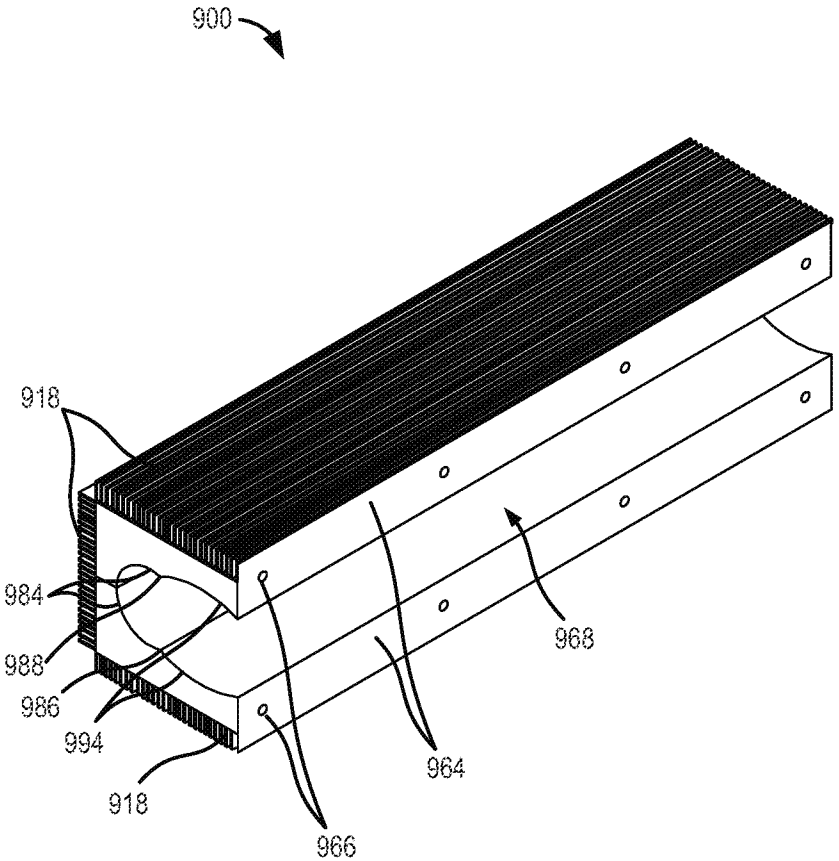
FIG. 9 illustrates a perspective view of a dual elliptical reflector for a photoreactive system.
Figure 11:
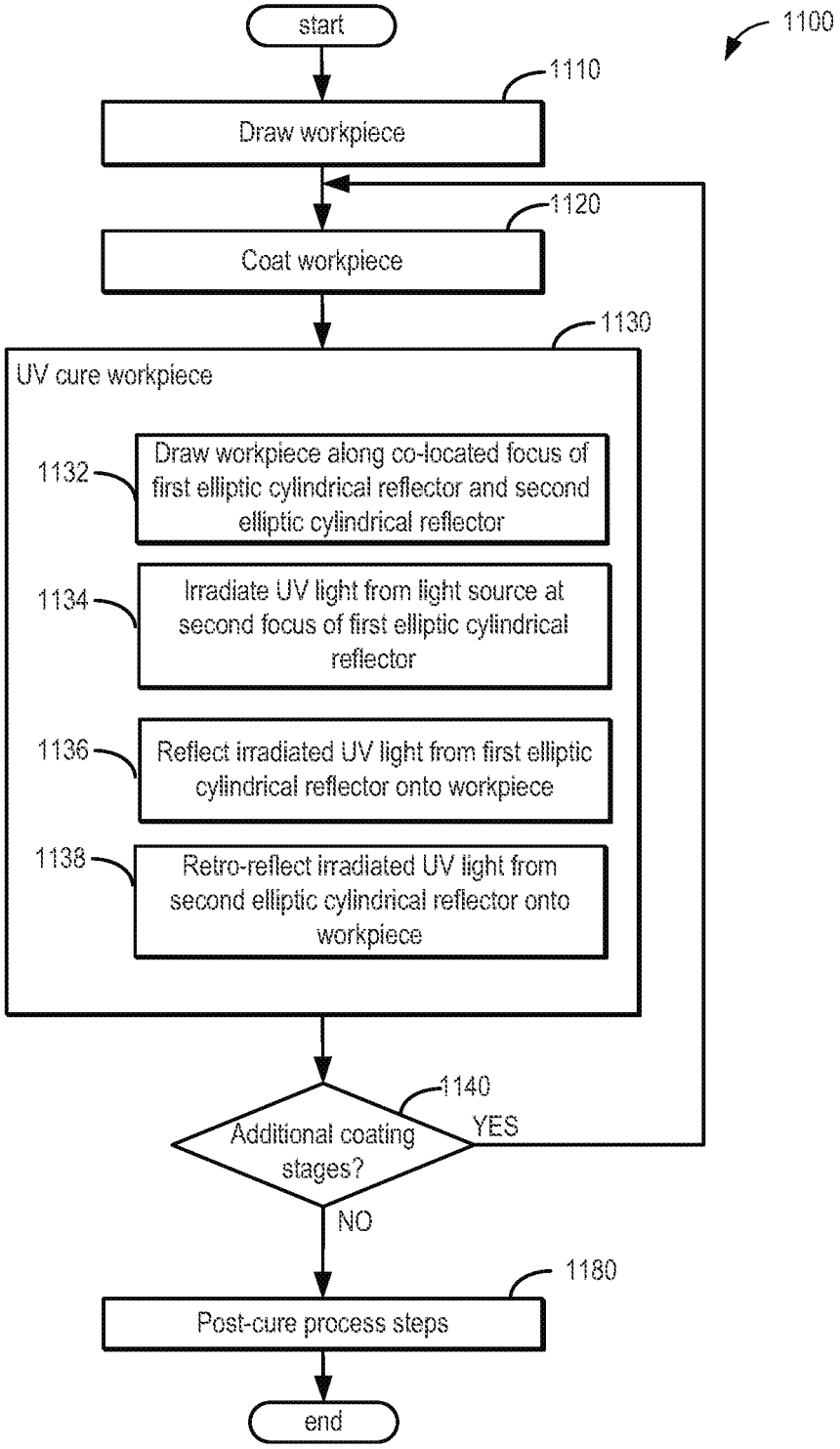
FIG. 11 illustrates a flowchart of an example method for curing a workpiece such as an optical fiber using, for example, the curing device such as shown in FIG. 5.

The present description is for a UV curing device, method and system for use in manufacturing coated optical fibers, ribbons, cables, and other workpieces. Optical fiber coatings may be UV-cured via a UV curing device employing dual elliptical reflectors arranged to have a co-located focus, wherein the workpiece (e.g., the optical fiber) is positioned at the co-located focus, and a UV light source is located at the second focus of the first elliptical reflector. FIG. 1 illustrates an example of a photoreactive system, comprising a power source, a controller, and a light-emitting subsystem. FIG. 2 shows a single elliptical reflector coupling optics configuration of a conventional UV curing device. FIG. 3 illustrates an example of two elliptical surfaces arranged to have a co-located focus. FIGS. 4-6 illustrate dual elliptical reflector coupling optics configurations for a UV curing device, wherein the dual elliptical reflectors have a co-located focus. FIG. 7-8 are cross-sectional and perspective views of an example UV curing device, including dual elliptical reflectors arranged to have a co-located focus. FIGS. 9-10 illustrate perspective and cross-sectional views of an example dual elliptical reflector. FIG. 11 is a flowchart showing steps of an example method for UV curing an optical fiber or other workpiece.

Referring now to FIG. 1, it illustrates a block diagram for an example configuration of a photoreactive system such as curing device 10. In one example, curing device 10 may comprise a light-emitting subsystem 12, a controller 14, a power source 16 and a cooling subsystem 18. The light-emitting subsystem 12 may comprise a plurality of semiconductor devices 19. The plurality of semiconductor devices 19 may be an array 20 of light-emitting elements such as a linear array of LED devices, for example. Array 20 of light-emitting elements may also comprise a two-dimensional array of LED devices, or an array of LED arrays, for example. Semiconductor devices may provide radiant output 24. The radiant output 24 may be directed to a workpiece 26 located at a fixed plane from curing device 10. Returned radiation 28 may be directed back to the light-emitting subsystem 12 from the workpiece 26 (e.g., via reflection of the radiant output 24).

The radiant output 24 may be directed to the workpiece 26 via coupling optics 30. The coupling optics 30, if used, may be variously implemented. As an example, the coupling optics may include one or more layers, materials or other structures interposed between the semiconductor devices 19 and window 64, and providing radiant output 24 to surfaces of the workpiece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such a micro-reflector array, each semiconductor device providing radiant output 24 may be disposed in a respective micro-reflector, on a one-to-one basis. As another example, an array of semiconductor devices 20 providing radiant output 24 may be disposed in macro-reflectors, on a many-to-one basis. In this manner, coupling optics 30 may include both micro-reflector arrays, wherein each semiconductor device is disposed on a one-to-one basis in a respective micro-reflector, and macro-reflectors wherein the quantity and/or quality of the radiant output 24 from the semiconductor devices is further enhanced by macro-reflectors. For example, macro-reflectors may comprise elliptic cylindrical reflectors, parabolic reflectors, dual elliptic cylindrical reflectors, and the like.

Each of the layers, materials or other structure of coupling optics 30 may have a selected index of refraction. By properly selecting each index of refraction, reflection at interfaces between layers, materials and other structures in the path of the radiant output 24 (and/or returned radiation 28) may be selectively controlled. As an example, by controlling differences in such indexes of refraction at a selected interface, for example window 64, disposed between the semiconductor devices to the workpiece 26, reflection at that interface may be reduced or increased so as to enhance the transmission of radiant output at that interface for ultimate delivery to the workpiece 26. For example, the coupling optics may include a dichroic reflector where certain wavelengths of incident light are absorbed, while others are reflected and focused to the surface of workpiece 26.

The coupling optics 30 may be employed for various purposes. Example purposes include, among others, to protect the semiconductor devices 19, to retain cooling fluid associated with the cooling subsystem 18, to collect, condense and/or collimate the radiant output 24, to collect, direct or reject returned radiation 28, or for other purposes, alone or in combination. As a further example, the curing device 10 may employ coupling optics 30 so as to enhance the effective quality, uniformity, or quantity of the radiant output 24, particularly as delivered to the workpiece 26.

Selected of the plurality of semiconductor devices 19 may be coupled to the controller 14 via coupling electronics 22, so as to provide data to the controller 14. As described further below, the controller 14 may also be implemented to control such data-providing semiconductor devices, e.g., via the coupling electronics 22. The controller 14 may be connected to, and may be implemented to control, the power source 16, and the cooling subsystem 18. For example, the controller may supply a larger drive current to light-emitting elements distributed in the middle portion of array 20 and a smaller drive current to light-emitting elements distributed in the end portions of array 20 in order to increase the useable area of light irradiated at workpiece 26. Moreover, the controller 14 may receive data from power source 16 and cooling subsystem 18. In one example, the irradiance at one or more locations at the workpiece 26 surface may be detected by sensors and transmitted to controller 14 in a feedback control scheme. In a further example, controller 14 may communicate with a controller of another lighting system (not shown in FIG. 1) to coordinate control of both lighting systems. For example, controllers 14 of multiple lighting systems may operate in a master-slave cascading control algorithm, where the setpoint of one of the controllers is set by the output of the other controller. Other control strategies for operation of curing device 10 in conjunction with another lighting system may also be used. As another example, controllers 14 for multiple lighting systems arranged side by side may control lighting systems in an identical manner for increasing uniformity of irradiated light across multiple lighting systems.

In addition to the power source 16, cooling subsystem 18, and light-emitting subsystem 12, the controller 14 may also be connected to, and implemented to control internal element 32, and external element 34. Internal element 32, as shown, may be internal to the curing device 10, while external element 34, as shown, may be external to the curing device 10, but may be associated with the workpiece 26 (e.g., handling, cooling or other external equipment) or may be otherwise related to a photoreaction (e.g. curing) that curing device 10 supports.

The data received by the controller 14 from one or more of the power source 16, the cooling subsystem 18, the light-emitting subsystem 12, and/or elements 32 and 34, may be of various types. As an example the data may be representative of one or more characteristics associated with coupled semiconductor devices 19. As another example, the data may be representative of one or more characteristics associated with the respective light-emitting subsystem 12, power source 16, cooling subsystem 18, internal element 32, and external element 34 providing the data. As still another example, the data may be representative of one or more characteristics associated with the workpiece 26 (e.g., representative of the radiant output energy or spectral component(s) directed to the workpiece). Moreover, the data may be representative of some combination of these characteristics.

The controller 14, in receipt of any such data, may be implemented to respond to that data. For example, responsive to such data from any such component, the controller 14 may be implemented to control one or more of the power source 16, cooling subsystem 18, light-emitting subsystem 12 (including one or more such coupled semiconductor devices), and/or the elements 32 and 34. As an example, responsive to data from the light-emitting subsystem indicating that the light energy is insufficient at one or more points associated with the workpiece, the controller 14 may be implemented to either (a) increase the power source's supply of power to one or more of the semiconductor devices, (b) increase cooling of the light-emitting subsystem via the cooling subsystem 18 (e.g., certain light-emitting devices, if cooled, provide greater radiant output), (c) increase the time during which the power is supplied to such devices, or (d) a combination of the above.

Individual semiconductor devices 19 (e.g., LED devices) of the light-emitting subsystem 12 may be controlled independently by controller 14. For example, controller 14 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array 20 of semiconductor devices, or may be from more than one array of semiconductor devices 20 from multiple lighting systems 10. Array 20 of semiconductor device may also be controlled independently by controller 14 from other arrays of semiconductor devices in other lighting systems. For example, the semiconductor devices of a first array may be controlled to emit light of a first intensity, wavelength, and the like, while those of a second array in another curing device may be controlled to emit light of a second intensity, wavelength, and the like.

As a further example, under a first set of conditions (e.g. for a specific workpiece, photoreaction, and/or set of operating conditions) controller 14 may operate curing device 10 to implement a first control strategy, whereas under a second set of conditions (e.g. for a specific workpiece, photoreaction, and/or set of operating conditions) controller 14 may operate curing device 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, but the different group of LED devices may include a subset of one or more LED devices from the second group.

The cooling subsystem 18 may be implemented to manage the thermal behavior of the light-emitting subsystem 12. For example, the cooling subsystem 18 may provide for cooling of light-emitting subsystem 12, and more specifically, the semiconductor devices 19. The cooling subsystem 18 may also be implemented to cool the workpiece 26 and/or the space between the workpiece 26 and the curing device 10 (e.g., the light-emitting subsystem 12). For example, cooling subsystem 18 may comprise an air or other fluid (e.g., water) cooling system. Cooling subsystem 18 may also include cooling elements such as cooling fins attached to the semiconductor devices 19, or array 20 thereof, or to the coupling optics 30. For example, cooling subsystem may include blowing cooling air over the coupling optics 30, wherein the coupling optics 30 are equipped with external fins to enhance heat transfer.

The curing device 10 may be used for various applications. Examples include, without limitation, curing applications ranging from ink printing to the fabrication of DVDs and lithography. The applications in which the curing device 10 may be employed can have associated operating parameters. That is, an application may have associated operating parameters as follows: provision of one or more levels of radiant power, at one or more wavelengths, applied over one or more periods of time. In order to properly accomplish the photoreaction associated with the application, optical power may be delivered at or near the workpiece 26 at or above one or more predetermined levels of one or a plurality of these parameters (and/or for a certain time, times or range of times).

In order to follow an intended application's parameters, the semiconductor devices 19 providing radiant output 24 may be operated in accordance with various characteristics associated with the application's parameters, e.g., temperature, spectral distribution and radiant power. At the same time, the semiconductor devices 19 may have certain operating specifications, which may be associated with the semiconductor devices' fabrication and, among other things, may be followed in order to preclude destruction and/or forestall degradation of the devices. Other components of the curing device 10 may also have associated operating specifications. These specifications may include ranges (e.g., maximum and minimum) for operating temperatures and applied electrical power, among other parameter specifications.

Accordingly, the curing device 10 may support monitoring of the application's parameters. In addition, the curing device 10 may provide for monitoring of semiconductor devices 19, including their respective characteristics and specifications. Moreover, the curing device 10 may also provide for monitoring of selected other components of the curing device 10, including its characteristics and specifications.

Providing such monitoring may enable verification of the system's proper operation so that operation of curing device 10 may be reliably evaluated. For example, curing device 10 may be operating improperly with respect to one or more of the application's parameters (e.g. temperature, spectral distribution, radiant power, and the like), any component's characteristics associated with such parameters and/or any component's respective operating specifications. The provision of monitoring may be responsive and carried out in accordance with the data received by the controller 14 from one or more of the system's components.

Monitoring may also support control of the system's operation. For example, a control strategy may be implemented via the controller 14, the controller 14 receiving and being responsive to data from one or more system components. This control strategy, as described above, may be implemented directly (e.g., by controlling a component through control signals directed to the component, based on data respecting that components operation) or indirectly (e.g., by controlling a component's operation through control signals directed to adjust operation of other components). As an example, a semiconductor device's radiant output may be adjusted indirectly through control signals directed to the power source 16 that adjust power applied to the light-emitting subsystem 12 and/or through control signals directed to the cooling subsystem 18 that adjust cooling applied to the light-emitting subsystem 12.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 19 beyond their specifications while also directing sufficient radiant energy to the workpiece 26, for example, to carry out a photoreaction of the application.

In some applications, high radiant power may be delivered to the workpiece 26. Accordingly, the light-emitting subsystem 12 may be implemented using an array of light-emitting semiconductor devices 20. For example, the light-emitting subsystem 12 may be implemented using a high-density, light-emitting diode (LED) array. Although LED arrays may be used and are described in detail herein, it is understood that the semiconductor devices 19, and arrays 20 thereof, may be implemented using other light-emitting technologies without departing from the principles of the invention; examples of other light-emitting technologies include, without limitation, organic LEDs, laser diodes, other semiconductor lasers.

Continuing with FIG. 1, the plurality of semiconductor devices 19 may be provided in the form of arrays 20, or an array of arrays (e.g., as shown in FIG. 1). The arrays 20 may be implemented so that one or more, or most of the semiconductor devices 19 are configured to provide radiant output. At the same time, however, one or more of the array's semiconductor devices 19 may be implemented so as to provide for monitoring selected of the array's characteristics. The monitoring devices 36 may be selected from among the devices in the array and, for example, may have the same structure as the other, emitting devices. For example, the difference between emitting and monitoring may be determined by the coupling electronics 22 associated with the particular semiconductor device (e.g., in a basic form, an LED array may have monitoring LED devices where the coupling electronics provides a reverse current, and emitting LED devices where the coupling electronics provides a forward current).

Furthermore, based on coupling electronics, selected of the semiconductor devices in the array may be either/both multifunction devices and/or multimode devices, where (a) multifunction devices may be capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices may be capable of emission, detection and some other mode (e.g., off) and may be switched among modes in accordance with the application parameters or other determinative factors.

As described above, curing device 10 may be configured to receive a workpiece 26. As an example, workpiece 26 may be a UV-curable optical fiber, ribbon, or cable. Furthermore, workpiece 26 may be positioned at or near the foci of coupling optics 30 of curing device 10 respectively. In this manner, UV light irradiated from curing device 10 may be directed via coupling optics to the surface of the workpiece for UV curing and driving the photoreactions thereat. Further still, coupling optics 30 of curing device 10 may be configured to have a co-located focus, as will be further described below.

Turning now to FIG. 2, it illustrates an example of a single elliptical reflector 200. Single elliptical coupling optics are used in conventional UV curing devices for curing coatings of optical fiber workpieces.

An ellipse is a plane curve that results from the intersection of a cone by a plane in a way that produces a closed curve, and is defined as the locus of all points of the plane whose distances to two fixed points (the foci of the ellipse) add to the same constant. The distance between antipodal points on the ellipse, or pairs of points whose midpoint is at the center of the ellipse, is maximum along its major axis or transverse diameter, and a minimum along its perpendicular minor axis or conjugate diameter. An ellipse is symmetric about its major and minor axes. The foci of the ellipse are two special points on the ellipse's major axis and are equidistant from the center point of the ellipse (where the major and minor axes intersect). The sum of the distances from any point on the ellipse to those two foci is constant and equal to the major axis. Each of these two points is called a focus of the ellipse. An elliptic cylinder is a cylinder having an elliptical cross section.

Elliptical reflector 200 comprises an elliptic cylinder having an elliptical cross section. An elliptical reflector 200 thus has two foci, wherein light irradiated from one focus along the axial length of the elliptic cylinder is concentrated at the second focus along the axial length of the cylinder. Elliptical reflector surface 210 is an example of a light control device having an elliptic cylindrical shape and elliptical cross section, such that light rays 250 emanating from a single light source 230 at a first focal point (e.g., a focal point along an axis of the elliptic cylinder) of the elliptical reflector are directed to a second focal point 240 (e.g., a focal point along a second axis of the elliptic cylinder). For UV curing, the interior surface of the elliptical reflector may be UV-reflective, to direct UV light substantially onto the surface of a workpiece located at the second focal point 240.

In single elliptical reflector devices with a single light source, the near-field workpiece surfaces (e.g., workpiece surfaces facing toward the light source) may receive light at higher intensities than the far-field workpiece surfaces (e.g., workpiece surfaces facing away from the light source). As such, single elliptical reflectors may also include a cylindrical back auxiliary reflector 260 in order to help in focusing UV light rays 264 emanating from light source 230 and being directed onto the far-field surface of the workpiece. Use of back auxiliary reflectors may be used thereby to provide for more uniform irradiation of a workpiece.

As described above, a conventional single elliptical reflector 200 has two foci, wherein light initiating from a light source 230 at a first focal point may be substantially concentrated at a second focal point 240.

Turning now to FIG. 3, it illustrates an example of two elliptical surfaces 310 and 320 that overlap and are connected forming a union of two partial elliptical surfaces. The ends at which the two partial elliptical surfaces are united form two edges 314 and 324 near the midpoints of the otherwise curved elliptical arcs. As shown in FIG. 3, elliptical surfaces 310 and 320 may be aligned about their major axes 352 and 350, and arranged such that they substantially share a co-located focus 330. Furthermore major axes 352 and 350 of elliptical surfaces 320 and 310 respectively are of equal length, and minor axes 356 and 358 of elliptical surfaces 310 and 310 respectively are of equal length. Elliptical surfaces 310 and 320 may be disposed on opposing sides of the workpiece positioned at or in the vicinity of the substantially co-located focus 330. Furthermore a light source may be positioned at or in the vicinity or encompassing one of the two foci 340 and 346 on opposing sides of the workpiece. The light source may, for example, be an individual LED device comprising an array of LEDs, or an array of LED arrays. In this arrangement, the dual elliptical surfaces can substantially concentrate light irradiated from the light source positioned at, or in the vicinity, of one of foci 340 and 346 of the dual elliptical reflectors onto the surfaces of the workpiece.

In this manner, reflecting irradiated light from dual elliptical reflectors renders surfaces of the workpiece that are far-field relative to the light source to be near-field relative to the second elliptical reflector (e.g., the reflector with no light source at the second non co-located focus). As such, the dual elliptical reflector design can potentially avoid using back reflectors, simplifying system design and cost. In this manner, the configuration exemplified in FIG. 3 can also potentially achieve higher irradiation intensity and more uniform irradiation intensity across the workpiece surfaces relative to single elliptical reflector UV curing devices. Achieving higher and more uniform irradiation intensity may potentially allow for increased production rates and/or shorter curing times, thereby reducing product manufacturing costs.

A further potential advantage of dual elliptical reflectors relative to single elliptical reflectors is that UV light can be concentrated more uniformly across all surfaces of the workpiece, while maintaining high intensity as compared to single elliptical UV curing devices. Furthermore because dual elliptical reflectors are utilized, light irradiated from the light sources can substantially be directed to the surface of the workpiece, even when there may be slight misalignment of the workpiece from the co-located focus, or slight misalignment of one or more light sources from one of the foci. Furthermore, in cases where the cross section of the workpiece may be irregularly shaped or asymmetrical, or in cases where the workpiece cross section may be large, light irradiated from the light sources can be substantially directed to the surface of the workpiece, when dual elliptical reflectors are utilized.

Elliptical surfaces 310 and 320 may be substantially elliptical, or at least partially elliptical, wherein the dual reflectors form substantially elliptic cylinders, and wherein light irradiated at or directed in the vicinity of foci 340 and 346 are reflected at the interiors of surfaces 310 and 320 substantially at co-located focus 330. For example, the shapes of surfaces 310 and 320 may depart slightly from perfectly elliptical without substantially compromising the convergence of light irradiated by a light source near or at one of foci 340 and 346 at co-located focus 330. As a further example, shapes of surfaces 310 and 320 departing slightly from perfectly elliptical can include faceted elliptical surfaces, wherein the general shape of the reflectors may be elliptical, but with individual sections faceted to slightly depart from an ellipse. Faceted or partially faceted elliptical surfaces may potentially allow for control of reflected light in a manner that enhances light uniformity or intensity at the workpiece surface for a given light source. For example, the facets may be flat or curved, smooth or continuous in nature, to approximate an elliptical shape, and may deviate slightly from an elliptical shape to account for the emission shape of the light source, thereby improving irradiance at a workpiece surface. Each of the facets may be flat, with corners connecting a plurality of the flat facets to form the elliptical surface. Alternatively, the facets may have a curved surface.

Turning now to FIG. 4, it illustrates a cross-section of an example coupling optics for a UV curing device 400 including dual elliptical reflectors 480 and 490 aligned about their major axes and arranged such that they share a co-located focus 460, as in the arrangement of the two elliptical surfaces 310 and 320 in FIG. 3. Elliptical reflector 490 may comprise a partial elliptical reflector, including an opening 430 opposite the co-located focus 460, the opening 430 symmetric about a major axis of elliptical reflector 490. Opening 430 may aid in mounting, positioning and/or aligning, and integrating the dual elliptical reflectors 480 and 490 with other components of UV curing device 400, such as a light source 420. Edges 432 of opening 430 are positioned such that opening 430 is not wider than an axis 436 parallel to the minor axis of elliptic reflector 490 at the second focus. A light source 420 may be positioned near or substantially at the second focus of the elliptical reflector 490. Furthermore, a sample tube 470 positioned so that its central axis is substantially centered about the co-located focus.

In this manner, the elliptical reflectors 480 and 490 form two partial elliptic cylinders joined at edges 486 and 488 where the elliptical reflectors 480 and 490 meet. UV curing device 400 may further be configured to receive a workpiece 450, wherein the workpiece 450 may pass inside the sample tube 470, so that its axis extends along the axis of the co-located focus 460. In this configuration, wherein the dual elliptical reflectors are disposed on opposing sides of the workpiece, the dual elliptical reflectors can substantially focus and direct light rays 424 and 428 irradiated from the light source 420 onto the workpiece surfaces in a substantially uniform manner and with high intensity. Herein, irradiating the workpiece in a substantially uniform manner may refer to irradiating all of the workpiece surfaces contained within the UV curing device with essentially the same irradiance (e.g., power per unit area). For example, for a workpiece comprising an optical fiber, positioning the light source 420 substantially at the second focus of the elliptical reflector 490 may facilitate irradiating the workpiece with a beam of constant irradiance within a threshold distance surrounding the fiber. As an example, the threshold distance may comprise a constant beam of 1 mm surrounding the fiber. As a further example, the threshold distance may comprise a constant beam of 3 mm surrounding the fiber.

Furthermore, because the dual elliptical reflectors are positioned on opposing sides of the workpiece, the surfaces of the workpiece that are near-field and far-field surfaces relative to the light source, are far-field and near-field, respectively, relative to the second elliptical reflector (e.g., the elliptical reflector having no light source at its non co-located focus). As such, far-field surfaces of the workpiece relative to either of the light source or the second elliptical reflector can be uniformly irradiated, precluding using back reflectors or reflective surfaces other than the interior surfaces of the dual elliptical reflectors to direct the light onto the workpieces. Further still, for cases where the workpiece passes within a sample tube 470, the size of the sample tube can limit how small the elliptical reflectors can be made because the walls of the sample tube 470 interfere with the reflector walls. Reducing the size of the elliptical reflectors may aid in positioning the light source closer to the workpiece. A dual elliptical reflector design overcomes this limitation by allowing for each elliptical reflector to have a smaller minor or smaller major axis in order to be able to position the light source closer to the workpiece.

Dual elliptical reflectors 480 and 490 can include a reflective interior surface 484 and 494 for directing light rays 428 and 424 emanating from light source 420. As shown, light irradiated from light source 420 may comprise light rays 424 which are reflected from reflective interior surface 494 of elliptical reflector 490 onto the workpiece surfaces, and light rays 428 which are reflected from reflective interior surface 484 of elliptical reflector 480 on to the workpiece surfaces. Light irradiated from light source 420 may further comprise light rays reflected from both reflective interior surfaces 484 and 494 of elliptic reflectors 480 and 490 respectively, onto the workpiece surfaces, and light rays 426 irradiated directly onto the workpiece surfaces from light source 420. Light rays 428 reflected from elliptic reflector 480 may pass through the second focus 482 of elliptic reflector 480 before being reflected by elliptic reflector 480 onto the workpiece surfaces.

The reflective interior surfaces 484 and 494 may reflect visible and/or UV and/or IR light rays with minimal absorption or refraction of light. Alternately, the reflective interior surfaces 484 and 494 may be dichroic such that a certain range of wavelengths of light may be reflected, whereas light of wavelengths outside a certain range may be absorbed at the reflective interior surfaces 484 and 494. For example, the reflective interior surfaces 484 and 494 may be designed to reflect UV and visible light rays, but absorb IR light rays. Such a reflective interior surface may be potentially useful for heat sensitive coatings or workpieces, or to moderate the rate and uniformity of the curing reaction at the surface of workpiece 450. On the other hand, the reflective interior surfaces 484 and 494 may preferentially reflect both UV and IR since curing reactions can proceed more rapidly at higher temperatures.

Workpiece 450 can include optical fibers, ribbons or cables having a range of sizes and dimensions. Workpiece 450 may also include a UV-curable cladding and/or surface coating, as well as UV-curable ink printed on its surface. UV-curable cladding can include one or more UV-curable polymer systems, and may also include more than one UV-curable layer, that may be UV-curable in one or more curing stages. UV-curable surface coatings may include a thin film, or an ink that is curable on the surface of the optical fiber or optical fiber cladding. For example, the workpiece may be an optical fiber comprising a core and cladding layer, and the cladding may include a coating comprising a UV-curable polymer such as a polyimide or acrylate polymer, or another one or more UV-curable polymers. As another example, a dual-layer coating may also be used, wherein the workpiece may be coated with an inner layer that may have a soft and rubbery quality when cured for minimizing attenuation by microbending, and an outer layer, which may be stiffer and suited for protecting the workpiece (e.g. optical fiber) from abrasion and exposure to the environment (e.g., moisture, UV). The inner and outer layers may comprise a polymer system, for example an epoxy system, comprising initiators, monomers, oligomers, and other additives.

During curing, the workpiece 450 may be pulled or drawn through the UV curing device in the axial direction, inside the sample tube 470, wherein the workpiece 450 is axially centered substantially about the co-located focus 460. Furthermore, the sample tube 470 may be axially centered about the co-located focus 460, and may concentrically surround the workpiece 450. Sample tube 470 may be constructed of glass, or quartz or another optically and/or UV and/or IR transparent material, and may not be overly thick in dimension, such that the sample tube 470 does not block or substantially interfere with the light rays irradiated from light source 42, including light rays reflected from the interior surface of dual elliptical reflectors 480 and 490 through the sample tube onto the surfaces of workpiece 450. Dual elliptical reflectors 480 and 490 may also be referred to compound elliptical reflectors. Sample tube 470 may have a circular cross-section, as shown in FIG. 4, or sample tube 470 may possess another suitably shaped cross-section. Sample tube 470 may also contain an inerting gas such as nitrogen, carbon dioxide, helium, and the like, in order to sustain an inert atmosphere around the workpiece and to reduce oxygen inhibition, which may slow the UV curing reaction.

Light source 420 may include one or more of semiconductor devices or arrays of semiconductor devices such as LED light sources, LED array light sources, or microwave-powered, or halogen arc light sources, or arrays thereof. Furthermore, light source 420 substantially located at focus 492, may extend along the axial length of the focus 492, so as to extend along the length of the partial elliptic cylindrical reflector 490 of the UV curing device 400. Light source 420, particularly arrays of light sources, or arrays of arrays of light sources, may further encompass or extend beyond focus 492 along or at points along the length of the partial elliptic cylindrical reflector 490 of UV curing device 400. In this manner, light irradiated from light source 420 along the axial length of the dual elliptical reflectors is substantially redirected to the surface of workpiece 450 along its entire length.

Furthermore, light source 420 may emit one or more of visible, UV, or IR light. As another example, light source 420 may irradiate UV light of a first spectrum during a first time period, and then may irradiate UV light of a second spectrum during a second time period. The first and second spectrums emitted by light source 420 may or may not overlap. For example, if the first light source 420 comprises a first LED array with a first type of LED light source and a second LED array with a second type of LED light source, then their emission spectra may or may not overlap. Furthermore, the intensities of light irradiated by light source 420 from the first LED array and the second LED array may be identical or they may be different, and their intensities can be independently controlled by an operator via a controller 14 or coupling electronics 22. In this manner, both the light intensity and wavelengths of light source 420 can be flexibly and independently controlled for achieving uniform UV irradiation and UV cure of a workpiece. For instance, if a workpiece is irregularly shaped, and/or is not symmetrical about the co-located focus of the dual elliptical reflector, the UV curing device may irradiate one portion of the workpiece differentially from another portion to achieve uniform cure. As another example if different coatings or inks are applied to the surface of the workpiece, the UV curing device may irradiate one portion of the workpiece differentially from another portion.

In a UV curing device with dual elliptical reflectors 480 and 490, and light source 420 positioned at a second focus of elliptical reflector 490, a workpiece positioned at the co-located focus 460 may be irradiated with UV light more uniformly and at higher intensities, as compared to UV curing devices employing only one elliptical reflector as illustrated in FIG. 2. In this manner, UV curing a workpiece using dual elliptical reflectors 480 and 490 and light source 420 positioned at a second focus of the elliptical reflector 490 may achieve faster curing rates and more uniform cure of the workpiece. In other words, faster curing rates can be achieved while achieving more uniform cure. In the case of a coated workpiece, non-uniform or unevenly coated workpieces may potentially experience non-uniform forces when the coating expands or contracts. For the case of an optical fiber, non-uniformly coated optical fibers can be more susceptible to greater signal attenuation. Achieving more uniform cure may include higher percent conversion of reactive monomer and oligomer, and higher degree of cross-linking in the polymer system, in addition to achieving concentric coatings around the workpiece (e.g., an optical fiber) that have constant thickness and are continuous over the application length of the workpiece (e.g., an optical fiber).

Achieving faster curing rates in a continuous or batch manufacturing process of optical fibers, cables, ribbons, or the like, may potentially reduce the manufacturing time and costs. Furthermore, achieving more uniform cure may potentially impart higher durability and strength to the workpiece. In the case of an optical fiber coating, increased coating uniformity may potentially preserve the fiber strength, thereby potentially increasing the durability of the optical fiber with respect to preventing attenuation of signal transmission due to phenomena such as microbending deformations, stress corrosion, or other mechanical damage in the optical fiber. Higher degrees of cross-linking may also potentially increase the chemical resistance of the coating, preventing chemical penetration and chemical corrosion or damage of the optical fiber. Optical fibers may be severely degraded by surface defects. With conventional UV curing devices, faster curing rates can be achieved, but only at the expense of reduced cure uniformity; similarly, more uniform cure can be achieved, but only at the expense of lowering curing rates.

In the case of the curing device 400, dual elliptical reflectors 480 and 490, have equal major axis and equal minor axis dimensions. In other embodiments, an example curing device may comprise dual elliptical reflectors with different major axes. Increasing or decreasing a major axis length of the elliptical reflectors can increase or decrease a distance between a co-located focus and a second focus of the elliptical reflectors.

Turning now to FIG. 5, it illustrates an example of a curing device 500 comprising dual elliptical reflectors 580 and 590 with a co-located focus 560 whose major axes are aligned along an axis 502, wherein the major axis of dual elliptical reflector 580 is less than the major axis of dual elliptical reflector 590. Dual elliptical reflectors 580 and 590 meet at external top edge 588 and bottom edge 586. In this manner, the elliptical reflectors 580 and 590 form two partial elliptic cylinders joined at edges 586 and 588 where the elliptical reflectors 580 and 590 meet. Internal and external surfaces of the dual elliptical reflectors 580 and 590 may be faceted, as shown in FIG. 5, wherein the general shape of the reflectors may be elliptical, but with individual sections 512 faceted to slightly depart from an ellipse. Faceted or partially faceted elliptical surfaces may potentially allow for control of reflected light in a manner that enhances light uniformity or intensity at the workpiece surface for a given light source. For example, the facets may be flat or curved, smooth or continuous in nature, to approximate an elliptical shape, and may deviate slightly from an elliptical shape to account for the emission shape of the light source, thereby improving irradiance at a workpiece surface. Each of the facets may be flat, with corners connecting a plurality of the flat facets to form the elliptical surface. Alternatively, the facets may have a curved surface.

A light source 520 is positioned at or in the vicinity of a second focus 592 of elliptical reflector 590, wherein a workpiece 550 is positioned at co-located focus 560, the workpiece concentrically surrounded by a sample tube 570. Elliptical reflector 590 may comprise a partial elliptical reflector, including an opening 530 opposite the co-located focus 560, the opening 530 symmetric about a major axis of elliptical reflector 590. Opening 530 may aid in mounting, positioning and/or aligning, and integrating the dual elliptical reflectors 580 and 590 with other components of curing device 500, such as a light source 520. Edges 532 of opening 530 are positioned such that opening 530 is not wider than an axis 536 parallel to the minor axis of elliptic reflector 590 at the second focus.

Curing device 500 may further be configured to receive a workpiece 550, wherein the workpiece 550 may pass inside the sample tube 570, so that its axis extends along the axis of the co-located focus 560. In this configuration, wherein the dual elliptical reflectors are disposed on opposing sides of the workpiece, the dual elliptical reflectors can substantially focus and direct light rays 524 and 528 irradiated from the light source 520 onto the workpiece surfaces in a substantially uniform manner and with high intensity. Dual elliptical reflectors 580 and 590 can include a reflective interior surface 584 and 594 for directing light rays 528 and 524 emanating from light source 520. As shown, light irradiated from light source 520 may comprise light rays 524 which are reflected from reflective interior surface 594 of elliptical reflector 590 onto the workpiece surfaces, and light rays 528 which are reflected from reflective interior surface 584 of elliptical reflector 580 on to the workpiece surfaces. Light irradiated from light source 520 may further comprise light rays reflected from both reflective interior surfaces 584 and 594 of elliptic reflectors 580 and 590 respectively, onto the workpiece surfaces, and light rays irradiated directly onto the workpiece surfaces from light source 520. Light rays 528 reflected from elliptic reflector 580 may pass through the second focus 582 of elliptic reflector 580 before being reflected by elliptic reflector 580 onto the workpiece surfaces.

By configuring the major axis of elliptical reflector 580 to have a major axis less than the major axis of elliptical reflector 590, a distance from the reflective interior surface 584 to the workpiece 550 may be reduced and may be less than a distance from the reflective interior surface 594 to the workpiece 550. Accordingly, an intensity and a uniformity of irradiated light reflected from elliptical reflector 580 onto far-field and mid-field surfaces (e.g., relative to light source 520) of workpiece 550 may be increased.

Turning now to FIG. 6 it illustrates another example of a curing device 600. Curing device 600 comprises dual elliptical reflectors 680 and 690 with a co-located focus 660 whose major axes are aligned along an axis 602. Furthermore, the major axis and the minor axis of elliptical reflector 680 are equal, and less than the minor axis of elliptical reflector 690. Accordingly, elliptical reflector 680 may comprise a circular reflector 680, the circular reflector 680 being a special case of an elliptical reflector whose major and minor axes are equal, and whose two foci are co-located. Thus, the focus (e.g., co-located foci) of circular reflector 680 is co-located with a first focus of elliptical reflector 690. Circular reflector 680 and elliptical reflector 690 meet at external top edge 688 and bottom edge 686. In this manner, the circular reflector 680 and elliptical reflector 690 form two partial cylinders joined at edges 686 and 688 where the circular reflector 680 and elliptical reflector 690 meet. Internal and external surfaces of the dual elliptical reflectors 680 and 690 may be faceted, as shown in FIG. 6, wherein the general shape of the reflectors may be elliptical, but with individual sections 612 faceted to slightly depart from an ellipse. Faceted or partially faceted elliptical surfaces may potentially allow for control of reflected light in a manner that enhances light uniformity or intensity at the workpiece surface for a given light source. For example, the facets may be flat or curved, smooth or continuous in nature, to approximate an elliptical shape, and may deviate slightly from an elliptical shape to account for the emission shape of the light source, thereby improving irradiance at a workpiece surface. Each of the facets may be flat, with corners connecting a plurality of the flat facets to form the elliptical surface. Alternatively, the facets may have a curved surface.

A light source 620 is positioned at or in the vicinity of a second focus 692 of elliptical reflector 690, wherein a workpiece 650 may be positioned at co-located focus 660, the workpiece concentrically surrounded by a sample tube 670. Elliptical reflector 690 may comprise a partial elliptical reflector, including an opening 630 opposite the co-located focus 660, the opening 630 symmetric about a major axis of elliptical reflector 690. Opening 630 may aid in mounting, positioning and/or aligning, and integrating the circular reflector 680 and elliptical reflector 690 with other components of curing device 600, such as a light source 620. Edges 632 of opening 630 are positioned such that opening 630 is not wider than an axis 636 parallel to the minor axis of elliptic reflector 690 at the second focus.

Curing device 600 may further be configured to receive a workpiece 650, wherein the workpiece 650 may pass inside the sample tube 670, so that its axis extends along the axis of the co-located focus 660. In this configuration, wherein the dual elliptical reflectors are disposed on opposing sides of the workpiece, the dual elliptical reflectors can substantially focus and direct light rays 624 and 628 irradiated from the light source 620 onto the workpiece surfaces in a substantially uniform manner and with high intensity. Circular reflector 680 and elliptical reflector 690 can include a reflective interior surface 684 and 694 for directing light rays 628 and 624 emanating from light source 620. As shown, light irradiated from light source 620 may comprise light rays 624 which are reflected from reflective interior surface 694 of elliptical reflector 690 onto the workpiece surfaces, and light rays 628 which are reflected from reflective interior surface 684 of circular reflector 680 on to the workpiece surfaces. Light irradiated from light source 620 may further comprise light rays reflected from both reflective interior surfaces 684 and 694 of circular reflector 680 and elliptical reflector 690 respectively, onto the workpiece surfaces, and light rays irradiated directly onto the workpiece surfaces from light source 620.

In configuring circular reflector 680 having a diameter smaller than the minor axis of elliptical reflector 690, a distance from the reflective interior surface 684 to the workpiece 650 is reduced and is less than a distance from the reflective interior surface 694 to the workpiece 650. Furthermore, a reflected path length or irradiated light from light source 620 via reflective interior surface 684 is reduced. Further still, the distance from all points on reflective interior surface 684 to the workpiece 650 is approximately uniform. Accordingly, an intensity and a uniformity of irradiated light reflected from circular reflector 680 onto far-field and mid-field surfaces (e.g., relative to light source 620) of workpiece 650 may be increased. Furthermore, fabricating a circular reflector may be less costly as compared to an elliptical (e.g., with unequal major and minor axes) reflector because of its greater symmetry.

Turning now to FIG. 7, it illustrates a cross-sectional view of an example of a photoreactive system, or a UV curing system 700. UV curing system 700 is shown, for illustrative purposes comprising a dual elliptic cylindrical reflector 775 comprising a circular cylindrical reflector 780 and an elliptical cylindrical reflector 790 similar to the curing device 600. UV curing system 700 may also comprise dual elliptic cylindrical reflectors as shown in curing devices 500 and 400. Circular cylindrical reflector 780 and elliptical cylindrical reflector 790 are joined at edges 786 and 788, forming partial elliptical surfaces, and having a co-located focus 760.

Light source 710 may include a housing 716, and inlet and outlet piping connections 714 through which cooling fluid may circulate. Light source 710 may comprise one or more arrays of UV LED's positioned substantially along a second focus 792 of the elliptic cylindrical reflector 790. UV curing system 700 may further comprise mounting brackets 718 by which the housing 716 may attach to a reflector assembly baseplate 720. UV curing system 700 may also include a sample tube 770 and a workpiece (not shown), for example an optical fiber, that is pulled or drawn within the sample tube 770 and positioned substantially about the central longitudinal axis of the sample tube 770. Longitudinal axis of sample tube 770 may be positioned substantially along a co-located focus 760 of the elliptic cylindrical reflector, wherein UV light originating from light source 710 may be substantially directed through the sample tube to surfaces of the workpiece by circular cylindrical reflector 780 and elliptic cylindrical reflector 790. Sample tube 770 may be constructed of quartz, glass or other material, and may have a cylindrical or other geometry, wherein UV light directed onto the external surface of the sample tube 770 may pass through the sample tube 770 without substantial refraction, reflection or absorption.

Reflector assembly baseplate 720 may be connected to reflector assembly faceplates 724, which may be mechanically fastened to either axial end of dual elliptical cylindrical reflector 775. Sample tube 770 may also be mechanically fastened to reflector assembly faceplates 724. In this manner, mounting brackets 718, reflector assembly faceplates 724 and reflector assembly baseplate 720 may serve to aid in aligning the light source 710, elliptic cylindrical reflector 775 and sample tube 770, wherein the light originating from light source 710 is substantially positioned about a second focus 792 of elliptic cylindrical reflector 790, wherein the sample tube is substantially positioned about a co-located focus of dual elliptic cylindrical reflector 775, and wherein UV light originating from light source 710 may be substantially directed through the sample tube 770 to surfaces of the workpiece by dual elliptic cylindrical reflector 775. Reflector assembly faceplate 724 may also include an alignment mechanism (not shown), where the alignment and/or position of the sample tube 770 may be adjusted after the reflector assembly faceplates 724, reflector assembly baseplate 720, elliptic cylindrical reflector 760 and sample tube 770 have been assembled together. Reflector assembly baseplate 720 may also be connected along one side to a reflector assembly mounting plate 740. Reflector assembly mounting plate 740 may further be provided with one or more mounting slots 744 (see FIG. 8) and one or more mounting holes 748 (see FIG. 8) by which UV curing system 700 can be mounted. UV curing system 700 may also include further connection ports 722 and 750 for other purposes such as for connecting electrical wiring conduits, mounting sensors, and the like. Furthermore, UV curing system 700 may comprise a reflector housing 712, and a cooling fan 715 mounted on the reflector housing 712 for removing heat from the UV curing system 700.

Turning now to FIG. 8, it illustrates a perspective cross-sectional view of the UV curing system 700 of FIG. 7, with reflector assembly faceplates 724 removed for illustration. In addition to the elements described above for FIG. 7, UV curing system 700 further comprises an opening or cavity 840 in reflector assembly baseplate 720 through which light irradiated from light source 710 is transmitted. As shown in FIG. 8, cavity 840 may substantially span an axial length of the dual elliptical reflector 775 so that light from light source 710 is irradiated along the entire length of the dual elliptical reflector 775. In addition to cooling fan 715 and inlet and outlet piping connections 714 for cooling fluid, reflector housing 712 may also comprise finned surfaces 820 for aiding in heat dissipation away from the UV curing system 700.

In the UV curing system 700 of FIG. 7 and FIG. 8, the dual elliptical reflector 775 is shown as having a thin rounded sheet construction. In one example, the dual elliptical reflector may comprise shaped thin sheets of polished aluminum that may be cleanable, reuseable, and replaceable. In another example, fins may be added to the external surface (e.g. external relative to the irradiated surface from light source 710) to increase heat transfer surface area from the dual elliptical reflector.

Turning now to FIGS. 9 and 10, they illustrate perspective and end cross-sectional views of another embodiment of a dual elliptical reflector 900 with co-located focus 982. Dual elliptical reflector 900 comprises reflective interior surfaces 984 and 994 of a first elliptical cylindrical reflector and a second elliptical cylindrical reflector joined at edges 986 and 988. As shown, the first elliptical cylindrical reflector comprises a circular cylindrical elliptical reflector, however, first elliptical cylindrical reflector may be any type of elliptical cylindrical reflector with a major axis and/or minor axis smaller than the major axis and/or minor axis of the second elliptical cylindrical reflector, respectively. Dual elliptical reflector 900 may be machined or cast metal, and polished to form reflective interior surfaces 984 and 994. Alternately, dual elliptical reflector may be machined, molded, cast or extruded of glass, ceramic, or plastic and treated with a high reflectance coating to form reflective interior surfaces 984 and 994. Further still, dual elliptical reflector may be fabricated in two halves, 900A and 900B and fit and/or joined together during assembly of the curing device. Dual elliptical reflector 900 further comprises finned surfaces 918 to increase heat transfer surface area. Mounting holes 966 may be provided on an underside 964 of the dual elliptical reflector 900 to facilitate mounting and positioning of the dual elliptical reflector 900 to other components of a UV curing system (e.g., UV curing system 700) such as a light source, or housing. Dual elliptical reflector 900 further comprises an opening or cavity 968 along its entire axial length. Cavity 968 is positioned along the major axis of the dual elliptical reflector 900 so that cavity 968 corresponds to the second focus 992 of the second elliptical cylindrical reflector.

In this manner, a curing device may comprise a first elliptic cylindrical reflector and a second elliptic cylindrical reflector, the first elliptic cylindrical reflector and the second elliptic cylindrical reflector arranged to have a co-located focus, and a light source located at a second focus of the first elliptic cylindrical reflector, wherein light emitted from the light source is reflected to the co-located focus from the first elliptic cylindrical reflector and retro-reflected to the co-located focus from the second elliptic cylindrical reflector. Furthermore, a light source may be absent at a second focus of the second elliptic cylindrical reflector. Further still, a first elliptic cylindrical reflector major axis may be greater than a second elliptic cylindrical reflector major axis, a first elliptic cylindrical reflector minor axis may be greater than a second elliptic cylindrical reflector minor axis, and the second elliptical reflector major axis and the second elliptical reflector minor axis may be equal.

The first elliptic cylindrical reflector and the second elliptic cylindrical reflector may be configured to receive a workpiece, and may be arranged on opposing sides of the workpiece. Elliptic surfaces of the first elliptic cylindrical reflector and the second elliptic cylindrical reflector may meet and be joined forming top and bottom edges near a central position of the curing device and extending along a major axial length of the first elliptic cylindrical reflector and a major axial length of the second elliptic cylindrical reflector, wherein the elliptic surfaces of the first elliptic cylindrical reflector and the second elliptic cylindrical reflector extend outward from the top and bottom edges to either side of the curing device where the elliptic cylindrical reflectors attach to the housing for the light source. Furthermore, the light source may comprise a power source, a controller, a cooling subsystem, and a light-emitting subsystem, the light-emitting subsystem including coupling electronics, coupling optics and a plurality of semiconductor devices, and the housing may contain the light source and include inlets and outlets for cooling subsystem fluid.

At least one of the first elliptic cylindrical reflector and the second elliptic cylindrical reflectors may be a dichroic reflector, and the plurality of semiconductor devices of the light source may comprise an LED array. The LED array may comprise a first LED and a second LED, the first LED and the second LED emitting UV light with different peak wavelengths. The curing device may further comprise a quartz tube axially centered around the co-located focus and concentrically surrounding the workpiece inside the curing device.

In another embodiment, a photoreactive system for UV curing, may comprise a power supply, a cooling subsystem, a light-emitting subsystem, and a UV light source located substantially at a second focus of the first elliptic cylindrical reflector. The light-emitting subsystem may comprise coupling optics, including a first elliptic cylindrical reflector and a second elliptic cylindrical reflector, the first elliptic cylindrical reflector and the second elliptic cylindrical reflector having a co-located focus and arranged on opposing sides of a workpiece. The photoreactive system may further comprise a controller, including instructions stored in memory executable to irradiate UV light from the UV light source, wherein the irradiated UV light is reflected by at least one of the first elliptic cylindrical reflector and the second elliptic cylindrical reflector and focused on to a surface of the workpiece, in the absence of a light source located at a second focus of the second elliptic cylindrical reflector. The controller may further comprise instructions executable to dynamically vary an intensity of the irradiated UV light, and the photoreactive system may further comprise the UV light source located substantially at the second focus of the first elliptic cylindrical reflector, wherein the irradiated UV light comprises a beam of spatially constant intensity surrounding the workpiece.

Turning now to FIG. 11, it illustrates a method 1100 of curing a workpiece, for example an optical fiber, optical fiber coating, or another type of workpiece. Method 1100 begins at 1110, where a workpiece may be drawn, in the case of an optical fiber, from a preform, in a workpiece drawing step. Method 1100 then continues at 1120 where the workpiece is coated with a UV-curable coating or UV-curable polymer system using a predetermined coating process.

Next, method 1100 proceeds with 1130, wherein the workpiece may be UV-cured. During the UV curing at 1130, the workpiece may be pulled or drawn through the sample tube of one or a plurality UV curing devices at 1132. For example the one or plurality of UV curing device may include one or more of curing devices 400, 500, 600 and/or 700, arranged linearly in series. Furthermore, the workpiece may be positioned along a co-located focus of a dual elliptical reflector of the UV curing device, for example, a co-located focus of a first elliptic cylindrical reflector and a second elliptic cylindrical reflector. UV curing the workpiece may further include irradiating UV light from at least one LED array light source positioned at a second focus of the first elliptic cylindrical reflector at 1134. The irradiated UV light may be reflected by the first elliptic cylindrical reflector onto the surface of the workpiece at 1136, and retro-reflected onto the surface of the workpiece at 1138. Further still, the workpiece may be UV cured in the absence of a light source positioned at a second focus of the second elliptic cylindrical reflector. Accordingly irradiated UV light may be uniformly directed onto a surface of the workpiece.

In the case of drawing and UV curing optical fibers, the linear speed at which the optical fiber may be pulled or drawn can be very fast, and may exceed 20 m/s, for example. Arranging a plurality of UV curing devices in series may thus allow the coated length of optical fiber to receive a long enough UV exposure residence time in order to substantially complete curing of the optical fiber coating. In some examples, the effective length of the UV curing stage (for example, the number of UV curing devices arranged in series) is determined by taking into account the manufacturing rate, or draw or linear speed of the optical fiber or workpiece. Thus if the optical fiber linear speed is slower, the length or number of the UV curing system stage may be shorter than for cases where the optical fiber linear speed is faster. In particular, using UV curing devices including a first elliptic cylindrical reflector and a second elliptic cylindrical reflector with a co-located focus may potentially provide higher intensity and more uniform UV light irradiated and directed onto the surface of the workpiece, thereby providing both faster and more uniform cure of the workpiece. In this manner, optical fiber coatings and/or inks may be UV-cured at higher production rates, thereby lowering manufacturing costs.

Complete UV curing of the optical fiber coating may impart physical and chemical properties such as strength, durability, chemical resistance, fatigue strength, and the like. Incomplete or inadequate curing may degrade product performance qualities and other properties that can potentially cause premature failure and loss of performance of the optical fiber. In some examples, the effective length of the UV curing stage (for example, the number of UV curing devices arranged in series) is determined by taking into account the manufacturing rate, or draw or linear speed of the optical fiber or workpiece. Thus if the optical fiber linear speed is slower, the length or number of the UV curing system stage may be shorter than for cases where the optical fiber linear speed is faster.

Next, method 1100 continues at 1140, where it is determined if additional coating stages are required. In some examples, dual or multi-layer coatings may be applied to the surface of the workpiece, for example an optical fiber. As discussed above, optical fibers can be manufactured to include two protective concentric coating layers. For example, a dual-layer coating may also be used, wherein the workpiece may be coated with an inner layer that may have a soft and rubbery quality when cured for minimizing attenuation by microbending, and an outer layer, which may be stiffer and suited for protecting the workpiece (e.g. optical fiber) from abrasion and exposure to the environment (e.g., moisture, UV). The inner and outer layers may comprise a polymer system comprising initiators, monomers, oligomers, and other additives. If an additional coating step is to be performed, then method 1100 returns to 1120 where the optical fiber or other workpiece (now coated with a UV-cured first layer) is coated via an additional coating step 1120 followed by an additional UV curing 1130. In FIG. 11, each coating step is shown as the optical fiber coating step 1120 for simple illustrative purposes, however, each coating step may not be identical such that each coating step may apply different types of coatings, different coating compositions, different coating thicknesses, and impart different coating properties to the workpiece. In addition the coating process 1120 may use different processing conditions (e.g., temperature, coating viscosity, coating method). Similarly, UV curing the workpiece 1130 for different coating layers or steps can involve a range of processing conditions. For example, in different UV cure steps, processing conditions such as UV light intensity, UV exposure time, UV light wavelength spectra, UV light source, and the like may be changed depending on the type of coating and/or coating properties.

Additional coating stages may also comprise printing or coating a UV curable ink or lacquer onto the surface of the workpiece, for example, for coloring or identification purposes. The printing may be carried out using a predetermined printing process, and may involve one or more multiple printing stages or steps. As such, UV curing at 1130 may comprise UV-curing a printed ink or lacquer on the surface of the workpiece. Similar to the UV curing step of the one or more optical fiber coatings, the printed ink or lacquer is UV-cured by pulling the workpiece positioned at the co-located focus of the first elliptic cylindrical reflector and the second elliptic cylindrical reflector of one or a plurality of UV curing devices arranged linearly in series, during which UV light is irradiated from the LED array light sources of the UV curing device(s) and directed by the dual elliptic cylindrical reflectors onto the surface of the optical fiber at the co-located focus.

If there are no additional coating stages, method 1100 continues at 1180 where any post-UV curing process steps are performed. As an example, for the case where the workpiece includes an optical fiber, post-UV curing process steps may include cable or ribbon construction, where a plurality of coated and printed and UV-cured optical fibers are combined into a flat ribbon, or a larger diameter cable composed of multiple fibers or ribbons. Other post-UV curing process steps may include co-extrusion of external cladding or sheathing of cables and ribbons.

In this manner, a method of curing a workpiece may comprise drawing the workpiece along a co-located focus of a first elliptic cylindrical reflector and a second elliptic cylindrical reflector, irradiating UV light from a light source positioned at a second focus of the first elliptic cylindrical reflector, reflecting the irradiated UV light from the first elliptic cylindrical reflector on to a surface of the workpiece, and retro-reflecting the irradiated UV light from the second elliptic cylindrical reflector onto the surface of the workpiece. The UV light may be irradiated from the light source at the second focus of the first elliptic cylindrical reflector in the absence of a light source positioned at a second focus of the second elliptic cylindrical reflector. Furthermore, drawing the workpiece along the co-located focus may comprise drawing at least one of an optical fiber, ribbon, or cable with at least one of a UV-curable coating, polymer, or ink. Further still, the LED array comprises a first LED and a second LED, wherein the first LED and the second LED emit UV light with different peak wavelengths.

The method may comprise dynamically varying an intensity of the irradiated UV light, and positioning the UV light source substantially at the second focus of the first elliptic cylindrical reflector, wherein the irradiated UV light comprises a beam of spatially constant intensity surrounding the workpiece.

In another embodiment, a method may comprise positioning a workpiece along a first interior axis of a reflector, wherein the reflector comprises first curved surfaces having a first curvature and second curved surfaces having a second curvature, positioning a light source along a second interior axis of the reflector, and emitting light from the light source, wherein the emitted light is reflected from the first curved surfaces and from the second curved surfaces onto the workpiece. The first interior axis may be coincident with a first focus of the first curved surfaces and a focus of the second curved surfaces, and the second interior axis may be coincident with a second focus of the first curved surfaces. Furthermore, the emitted light may be singly reflected from the first curved surface prior to reaching the workpiece, and the emitted light may be multiply reflected from the second curved surface prior to reaching workpiece. Further still, the light source may comprise an LED array including a first LED and a second LED, wherein light is emitted from the first LED with a first peak wavelength and from the second LED with a second peak wavelength.

It will be appreciated that the configurations disclosed herein are exemplary in nature, and that these specific embodiments are not to be considered in a limiting sense, because numerous variations are possible. For example, the above embodiments can be applied to workpieces other than optical fibers, cables, and ribbons. Furthermore, the UV curing devices and systems described above may be integrated with existing manufacturing equipment and are not designed for a specific light source. As described above, any suitable light engine may be used such as a microwave-powered lamp, LED's, LED arrays, and mercury arc lamps. The subject matter of the present disclosure includes all novel and non-obvious combinations and subcombinations of the various configurations, and other features, functions, and/or properties disclosed herein.

Note that the example process flows described herein can be used with various UV curing devices and UV curing system configurations. The process flows described herein may represent one or more of any number of processing strategies such as continuous, batch, semi-batch, and semi-continuous processing, and the like. As such, various acts, operations, or functions illustrated may be performed in the sequence illustrated, in parallel, or in some cases omitted. Likewise, the order of processing is not necessarily called for to achieve the features and advantages of the example embodiments described herein, but is provided for ease of illustration and description. One or more of the illustrated acts or functions may be repeatedly performed depending on the particular strategy being used. It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and subcombinations of the various systems and configurations, and other features, functions, and/or properties disclosed herein.

The following claims particularly point out certain combinations and subcombinations regarded as novel and non-obvious. These claims may refer to "an" element or "a first" element or the equivalent thereof. Such claims are to be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A lighting device, comprising:

a reflector housing, a compound elliptic cylindrical reflector mounted to the reflector housing, the compound elliptic cylindrical reflector comprising a first elliptic cylindrical reflector and a second elliptic cylindrical reflector joined at cusped edges, and a light source mounted to the reflector housing and positioned at a second focus of the first elliptic cylindrical reflector, wherein radiation emitted from the light source is focused by the compound elliptic cylindrical reflector on to a co-located focus of the first elliptic cylindrical reflector and the second elliptic cylindrical reflector, wherein a second, non-co-located focus of the second elliptic cylindrical reflector is without any light source.

2. The lighting device of claim 1, wherein the cusped edges extend along a length of the first elliptic cylindrical reflector and the second elliptic cylindrical reflector.

3. The lighting device of claim 1, wherein the compound elliptic cylindrical reflector comprises only one co-located focus.

4. The lighting device of claim 1, wherein the first elliptic cylindrical reflector and the second elliptic cylindrical reflector are coincident only at the cusped edges.

5. The lighting device of claim 1, wherein only one of the major axes and the minor axes of the first elliptic cylindrical reflector and the second elliptic cylindrical reflector are collinear.

6. The lighting device of claim 5, wherein a major axis of the first elliptic cylindrical reflector is collinear with a major axis of the second elliptic cylindrical reflector.

7. The lighting device of claim 1, wherein the cusped edges form singularities in a curvature of the compound elliptic cylindrical reflector.

8. The lighting device of claim 1, wherein the curvature of the compound elliptic cylindrical reflector reverses direction at the cusped edges.

9. A method, comprising:

positioning a workpiece along a first interior axis of a reflector, wherein the reflector comprises first curved surfaces having a first curvature and second curved surfaces having a second curvature, and joining the first curved surfaces to the second curved surfaces at cusped edges;

positioning a light source at a focus of the first curved surfaces along a second interior axis of the reflector without positioning any light source at a focus of the second curved surfaces, wherein the focus of the second curved surfaces includes a non-co-located focus of the first curved surfaces and the second curved surfaces; and emitting light from the light source, wherein the emitted light is reflected from the first curved surfaces and from the second curved surfaces onto the workpiece.

10. The method of claim 9, wherein positioning the workpiece along the first interior axis of the reflector includes positioning the workpiece at a co-located focus of the first curved surfaces and the second curved surfaces.

11. The method of claim 9, wherein positioning the workpiece along the first interior axis of the reflector includes positioning the workpiece along an interior axis of the first curved surfaces.

12. The method of claim 11, wherein positioning the workpiece along the first interior axis of the reflector includes positioning the workpiece along an interior axis of the second curved surfaces.

13. The method of claim 9, wherein joining the first curved surfaces to the second curved surfaces at the cusped edges includes joining the first curved surfaces to the second curved surfaces, wherein the first curvature is different from the second curvature.

14. The method of claim 9, wherein joining the first curved surfaces to the second curved surfaces at the cusped edges includes contiguously joining the first curved surfaces to the second curved surfaces.

15. The method of claim 9, wherein joining the first curved surfaces to the second curved surfaces at the cusped edges includes joining the first curved surfaces to the second curved surfaces at the cusped edges wherein the cusped edges extend along a length of the reflector.

16. A curing system, comprising:

a light-emitting subsystem comprising, a first elliptic cylindrical reflector and a second elliptic cylindrical reflector, the first elliptic cylindrical reflector and the second elliptic cylindrical reflector contiguously joined at cusped edges and having a co-located focus; and a light source located substantially at a second focus of the first elliptic cylindrical reflector, wherein a second, non-co-located focus of the second elliptic cylindrical reflector is without any light source; and a controller, including instructions stored in memory executable to irradiate light from the light source, wherein the irradiated light is reflected by at least one of the first elliptic cylindrical reflector and the second elliptic cylindrical reflector and focused on to a workpiece positioned at the co-located focus.

17. The curing system of claim 16, wherein the first elliptic cylindrical reflector comprises an opening opposite the co-located focus and symmetric about an interior axis of the first elliptic cylindrical reflector.

18. The curing system of claim 16, wherein the co-located focus is positioned along an axis coincident with the cusped edges.

19. The curing system of claim 16, wherein the cusped edges are symmetric about an interior axis of the first elliptic cylindrical reflector.

20. The curing system of claim 16, wherein the second focus of the first elliptic cylindrical reflector includes a non-co-located focus.

* * * * *